US008281927B2

(12) United States Patent
Smith

(10) Patent No.: US 8,281,927 B2
(45) Date of Patent: Oct. 9, 2012

(54) SHIPPING AND DISPLAY TRAY WITH ARTICLE SUPPORT

(75) Inventor: Jeffrey A. Smith, Medford, NJ (US)

(73) Assignee: International Paper Co., Memphis, TN (US)

( * ) Notice: Subject to any disclaimer, the term of this patent is extended or adjusted under 35 U.S.C. 154(b) by 90 days.

(21) Appl. No.: 12/963,155

(22) Filed: Dec. 8, 2010

(65) Prior Publication Data

US 2012/0018348 A1 Jan. 26, 2012

Related U.S. Application Data

(60) Provisional application No. 61/366,975, filed on Jul. 23, 2010.

(51) Int. Cl.
*B65D 79/00* (2006.01)

(52) U.S. Cl. ..... 206/485; 206/526; 229/120.18; 229/120.21

(58) Field of Classification Search ..... 206/526, 206/485, 764, 774, 768, 815; 229/120.18, 229/120.21
See application file for complete search history.

(56) References Cited

U.S. PATENT DOCUMENTS

| | | | | | |
|---|---|---|---|---|---|
| 2,136,797 | A * | 11/1938 | Lee | 206/768 |
| 2,914,236 | A * | 11/1959 | Shapiro | 206/767 |
| 3,326,361 | A * | 6/1967 | Zimmerman | 206/765 |
| 3,674,133 | A * | 7/1972 | Locke | 206/767 |
| 3,927,761 | A * | 12/1975 | Boyle | 206/756 |
| 4,485,922 | A * | 12/1984 | Desmond et al. | 206/485 |
| 5,154,292 | A * | 10/1992 | Bartucca et al. | 206/449 |
| 6,138,902 | A * | 10/2000 | Welch | 229/103.11 |
| 6,367,632 | B1 * | 4/2002 | Green | 206/764 |
| 6,431,363 | B1 | 8/2002 | Hacker | |
| 6,942,102 | B2 | 9/2005 | Justice | |
| 6,962,260 | B2 | 11/2005 | Jay et al. | |
| 6,966,447 | B2 | 11/2005 | Hiltke et al. | |
| 7,624,876 | B1 * | 12/2009 | Green | 206/764 |
| 2002/0175106 | A1 * | 11/2002 | Nemoto | 206/526 |
| 2007/0256952 | A1 * | 11/2007 | Kim-Gifford et al. | 206/485 |

FOREIGN PATENT DOCUMENTS

| | | |
|---|---|---|
| EP | 2033899 | 3/2009 |
| FR | 44378 | 12/1934 |
| FR | 965621 | 9/1950 |

* cited by examiner

*Primary Examiner* — David Fidei
(74) *Attorney, Agent, or Firm* — Matthew M. Eslami

(57) ABSTRACT

The present invention is directed to a shipping and display tray for holding a plurality of articles contained therein in an upright position at a point of sale. The shipping and display tray is made of paperboard and defined by a one-piece shallow tray having a bottom wall, a front wall, a back wall, and opposite side walls foldably joined with one another. A plurality of parallel spaced apart bumpers are foldably joined to the respective opposite side walls and forming two rows, an aisle, and a plurality of channels when positioned on the bottom wall. The plurality of the channels engages with bottom edges of the plurality of articles to hold the article in standing upright position and prevent the articles from falling over when one of the articles is removed from the display tray. The front wall of the tray includes a flap panel foldably joined thereto and has a pair of openings used to engage with the bumpers.

8 Claims, 7 Drawing Sheets

SHIPPING AND DISPLAY TRAY WITH ARTICLE SUPPORT

CROSS REFERENCE TO RELATED APPLICATION

This application claims priority to U.S. provisional patent application Ser. No. 61/366,975, filed on 23 Jul. 2010, which is hereby incorporated hereunto by reference as if fully restated herein.

FIELD OF THE INVENTION

This invention relates generally to a shipping and display container, constructed from a unitary paperboard blank for holding a plurality of articles and more particularly, to a shipping and display tray having a plurality of bumpers and a locking feature and is easily assembled and reduces the amount of paperboard typically used in similar packages.

BACKGROUND OF THE INVENTION

Many products for sale to the public are placed in a primary package that is designed for display at the point of sale. One common practice is to place a quantity of the primary packages in a secondary container for shipping. The retailer must then remove the primary packages from the secondary container and hang them from a hook or place them in another container or on a costly permanent plastic or metal display fixture with spring loaded attachments. This solution is labor intensive and costly to the retailer.

To overcome this problem, packages have been designed that are used for both shipping the primary packages and then displaying them at the point of sale. These packages are especially convenient for the retailer, since it is not necessary for the retailer to remove the articles from a bulk shipping container.

One conventional container for both shipping articles and then displaying them with maximum visual exposure at a point of sale comprises a tray having a smooth bottom wall and relatively narrow upstanding side walls. The articles are supported on the bottom wall and preferably extend above the side walls. For shipping, a cover is placed over the tray loaded with articles or the loaded tray is placed in an outer shipping container to form a shipping package. When the shipping package reaches its destination the tray loaded with articles is removed from the shipping container and placed on a shelf or other surface for display and sale of the items supported in the tray.

A commonly used primary package comprises a blister pack or clamshell package which the article is placed on a sheet of cardboard or plastic and then covered by a plastic sheet or bubble that is sealed around the edges to the sheet. These packages are collectively referred to hereinafter as blister packs or blister cards, but it should be understood that this terminology is intended to cover any generally flat package having at least one substantially straight projecting marginal edge. A plurality of blister packs is placed in upright position in these trays. However, because of their shape and the location of their center of gravity, most blister packs tend to fall over or slide forward at their bottom edge and are therefore no longer supported in an upright position when some of the articles are removed by consumers from the front of the tray. Consequently, for blister packs to be properly displayed in a display tray, it is necessary to provide a support structure to hold the blister packs in an upright position even when some of the blister packs are removed from the front of the tray.

One prior art system that has been proposed utilizes a separate insert positioned in the tray and having slots or protuberances that engage opposite side and/or bottom edges of the blister packs to hold them upright even after some blister packs have been removed from the tray. Other prior art systems comprise specially constructed and folded walls that extend into the interior of the tray and have slots for receiving edges of the blister packs to hold them upright. All of these prior art systems require either additional parts, such as inserts placed in the tray, or excess material to form the specially constructed and folded walls.

Therefore, it is desirable to have shipping and display tray that supports and displays articles in an upright position for optimum visibility at a point of sale without the need for separate inserts or excess material, thereby minimizing the complexity and cost of such display trays.

SUMMARY OF THE INVENTION

Some of the advantages of the present invention shipping and display tray is to: 1) provide a printed surface on inside side walls of the assembled tray 2) have a sidewall height that would help to support and stabilize the blister cards used inside which the blister cards and the side walls are the same height 3) hold the blister cards in place by using bumpers or air cells 4) increase efficiencies in set-up time 5) display product fully from front and provide easy removal and possible replacement of product 6) creates sidewalls that slope back or tapered downwardly to maximize visual exposure of the blister cards in front and 7) reduce square footage of cardboard used.

Other advantages of the present invention are: 1) Reduced labor in set up time due to pre-glued bumpers. No prior known holding display trays currently incorporate this feature. Other holding display trays use several parts to accomplish the same requirements. This increases time to assemble and also the cost of the overall package. 2) Option of using a unique "pop-up" front tab that allows the blister cards to be held with two shorter width bumpers. These two shorter width bumpers enable the blister cards to position product lower to the bottom and increase product contained or improve billboard effect of smaller sized blisters. Pop-up front tab is an optional feature. 3) Optional locking tabs in the two shorter width bumpers were also developed to provide a more positive locking mechanism during assembly. 4) When looking at this display tray from a marketing standpoint, it provides several areas that can be utilized as printed surfaces when conventional printing techniques are used. Printing on the outside of the sheet provides all areas of the assembled structure (except the back inside) with printed areas. This helps to increase market driven solutions through graphics.

Accordingly, one aspect of the present invention is directed to a shipping and display tray for holding a plurality of articles contained therein in an upright position at a point of sale. The shipping and display tray is made of paperboard and defined by a one-piece shallow tray having a bottom wall, a front wall, a back wall, and opposite side walls foldably joined with one another. A plurality of parallel spaced apart bumpers are foldably joined to the respective opposite side walls and forming two rows, an aisle, and a plurality of channels when positioned on the bottom wall. The plurality of the channels engages with bottom edges of the plurality of articles to hold the article in standing upright position and prevent the articles from falling over when one of the articles is removed from the display tray. The front wall of the tray includes a flap panel foldably joined thereto and has a pair of openings used to engage with the bumpers. Two of the plurality of bumpers each of which has a tab that is inserted into the respective openings. The front wall also includes a pop-up front used to enhance surface area of the front wall for printing indicia.

Another aspect of the present invention is directed to a shipping and display tray for holding a plurality of articles contained therein in an upright position at a point of sale. The shipping and display tray is made of paperboard and defined by a one-piece shallow tray having a bottom wall, a front wall having a flap panel foldably joined thereto, a back wall, and opposite side walls foldably joined with the flap panel. The bottom wall contains a plurality of parallel spaced apart bumpers having at least one row and a plurality of channels used to engage with bottom edges of the plurality of articles to hold the article in standing upright position and prevent the articles from falling over when one of the articles is removed from the display tray.

A further aspect of the present invention is directed to a blank for making the shipping and display tray, as noted hereinabove, for supporting a plurality of articles in an upright position and displaying them at the point of sale. The blank has a rectangularly shaped bottom wall panel having opposite end edges and opposite side edges. A side wall panel is foldably attached to each of the opposite side edges. A front wall panel is foldably attached to one of the opposite end edges of the bottom wall panel. The front wall panel being defined by a flap panel and a pop-up front foldably joined to one another. A pair of openings is formed on the flap panel and a plurality of spaced apart parallel slots extends across two parallel fold lines formed on the side wall panels. The blank is folded transversely in half along a fold line to join the side wall panels to one another along glue areas.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE INVENTION

Figure 1:
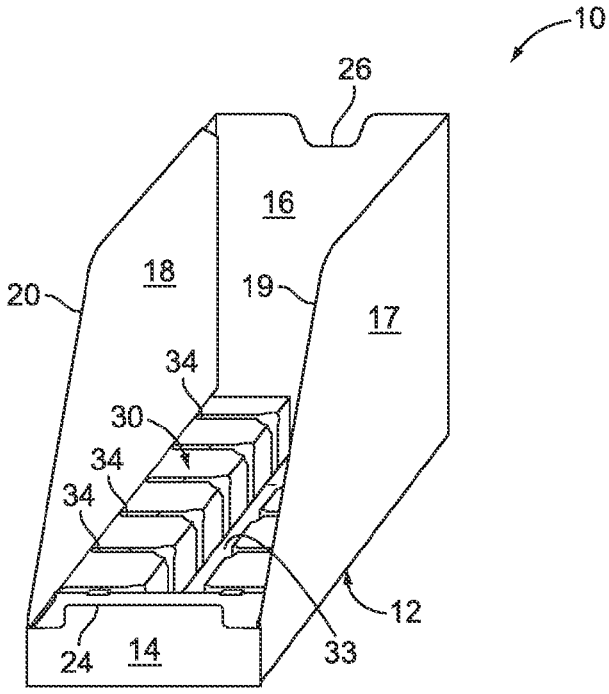
FIG. 1 is a top perspective view of a shipping and display tray according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same or those elements are in the unfolded position.

FIG. 1 is a top perspective view of a shipping and display tray 10 according to the invention. The display tray 10 includes a bottom wall 12, front wall 14, back wall 16, and opposite side walls 17 and 18. In the particular example shown, the front wall 14 has much less height than the back wall 16 and the upper edges 19, 20 of the side walls adjacent the front wall 14 are tapered downwardly to enhance exposure of the plurality of articles, such as blister cards 22 in the display tray 10. However, one of the ordinary skilled in the art would appreciate that the tapering off the side walls 17 and 18 are optional and has no bearing on the function of the display tray. The front wall 14 include an optional extend upwardly pop-up front 24 formed from the free edge thereof to enhance the surface area of the front wall for printing indicia and the like. The upper edge of the back wall 16 includes a generally U-shaped cutout 26 formed therein to facilitate the removal of the last article from the display tray 10.

A plurality of spaced apart, parallel bumpers or air cells 30 are positioned in the bottom portion of the display tray 10 to securely hold the blister cards 22 so that it support the articles in their upright position in the tray. The plurality of the bumpers 30 configured to rest on opposed longitudinal side of the bottom wall 12 in a manner that forms an aisle 33 in the middle of the bottom wall 12. Each of the bumpers 30 is generally rectangular in shape and has a height that substantially the same as the height of the front wall 14. The bumpers or air cells 30 have all the same width except the two bumpers 30*a*, 30*b* (as best depicted in FIG. 6B) that are adjacent to the front wall 14 as will be described in greater detail hereinafter. Each of the bumpers 30*a*, 30*b* includes a respective tab 31*a*, 31*b* (FIG. 6D) that engages with the front wall 14 to securely attach the sidewalls 17, 18, the back wall, 16 and the bottom wall 12 to the front wall 14. When the bumpers 30 are in side by side position with one another, they form two rows with a plurality of channels 34 which are used to hold the blister cards. With the foregoing structure, when the plurality of blister cards 22 are placed in the display tray 10, the respective bottom edges of the blister cards 22 are securely received in the respective channels 34 so that the blister cards 22 in the display tray are prevented from sliding forward, whereby the blister cards 22 are held in their upright positions as depicted in FIG. 2.

Figure 2:
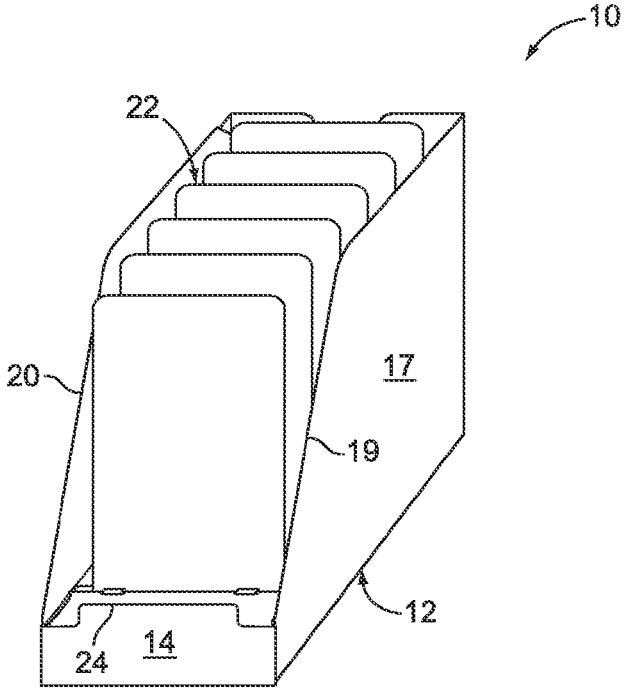
FIG. 2 is similar to FIG. 1 illustrating the display tray loaded with articles.
Figure 3:
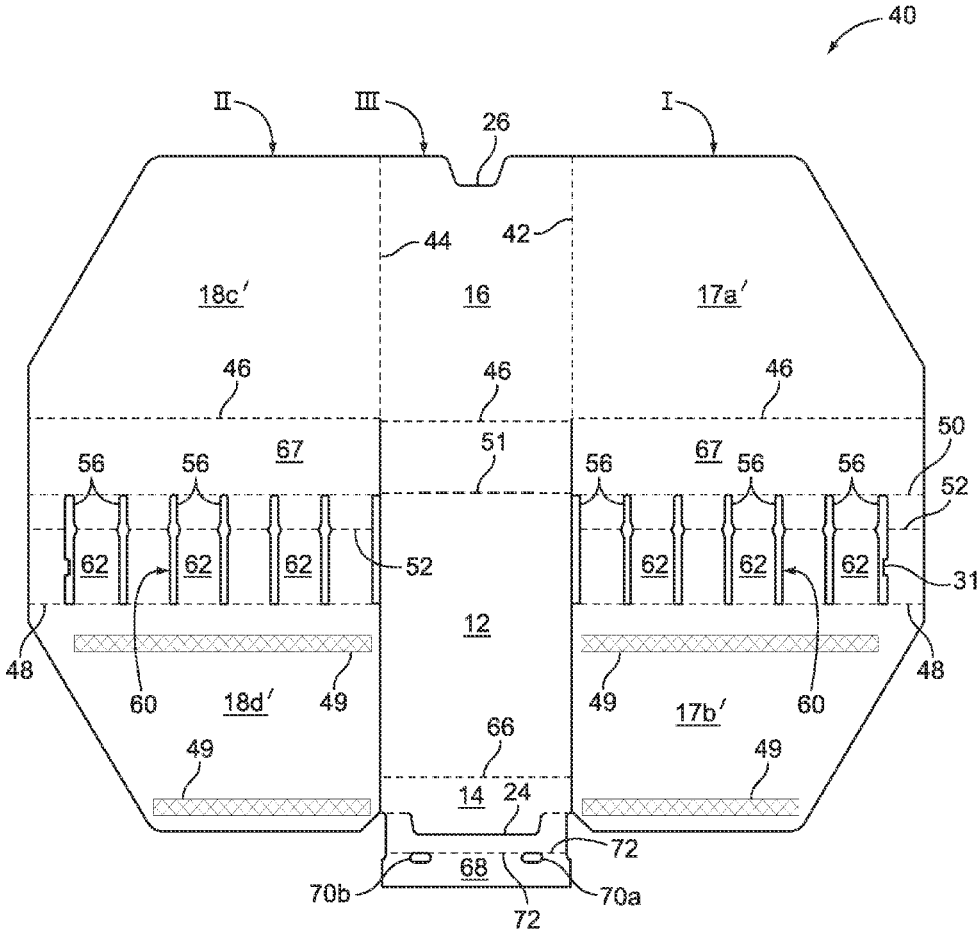
FIG. 3 is a paperboard blank used to construct the display tray shown in FIGS. 1 and 2.

FIG. 3 is a plan view of a cut and scored paperboard blank 40 for forming a display tray 10 depicted in FIGS. 1 and 2 in accordance to the present invention. The blank 40 is substantially flat symmetrical with respect to its longitudinal axis thereof. The blank 40 is preferably an integral piece of a material such as continuous sheet of conventional corrugated cardboard. The blank 40 is cut along its outer margins to form its specific shape. The blank 40 is divided into three sections I, II, III by two longitudinal fold lines 42, 44. When the blank 40 is fully constructed, the sections I and II form the opposed side walls and the bumpers 30 of the display tray 10, and the section III forms the back 16, bottom 12, and front wall 14 of the display tray 10. In the exemplary blank 40, it should be noted that the section I and II are mirror images of one another with respect to the section III. Each of the sections I and II are further divided by respective fold lines 46 and 48. The area between fold lines 46, 48 is used to construct the plurality of bumpers or air cell 30 and the panels 17*a*', 17*b*', the panels 18*c*', 18*d*' are used to construct the respective opposed side walls 17, 18 of the display tray 10. The blank 40 is folded substantially in half along the longitudinal fold line 50 when the respective panels 17*b*', 18*d*' are glued to the respective panels 17*a*' and 18*c*' by the designated glue areas 49. The pre-glued blank 40 takes much less space during shipping and transportation and can be easily assembled to construct the display tray 10.

The plurality of bumpers or air cells 30 are constructed from a series of parallel spaced apart slots 34' formed in the sections I and II. It should be noted that the channel 34 is constructed from the slot 34' when the blank 40 is fully constructed. The length of the slots 34' are defined by the length between the fold lines 48 and 52. When in folded position, the area between fold lines 48, 52 and the slots 34' forms the top surface 62 of the bumpers 30, the area between fold lines 50, 52 and the slots 34' forms the side surfaces 64 of the bumpers 30, and the area between the fold lines 50, 46 and the slots 34' forms the bottom surfaces 67 of the bumpers 30, respectively.

As noted above, the section III is characterized by the back wall panel 16', bottom wall panel 12', and front wall panel 14'. The back wall panel 16', bottom wall panel 12' and the front wall panel 14' are defined by respective fold lines 46 and 66. The partial score line 51 is used for shipping and production and provides a smaller blank for pelletization and is not used in the final assembly of the foregoing structure described hereinabove. As noted above, the back wall 16 includes a generally U-shaped cutout 26 formed therein to facilitate the removal of the last article from the display tray when the blank is in the folded position. The front wall panel 14' includes a flap 68 at its free edge that is defined by the fold line 72. The front wall panel 14' also includes a generally U-shaped cutline 24' that forms the pop-up front 24 depicted in FIG. 1 when the front wall panel 14' is fully engaged with the bumpers 30*a*, 30*b*. The flap 68 has a pair of spaced apart openings 70*a*, 70*b* formed near the fold line 72. The openings 70*a*, 70*b* are used to engage with the respective tabs 31*a*, 31*b* on the bumpers 30*a*, and 30*b*. However, one of the ordinary skilled in the art would appreciate that the tabs 31*a*, 31*b* and the openings 70*a*, 70*b* are optional since the engagement of flap 68 with bumpers 30*a*, 30*b* would be sufficient to securely hold the front wall 14, back wall 16, and sidewalls 17, 18 to one another.

Figure 4:
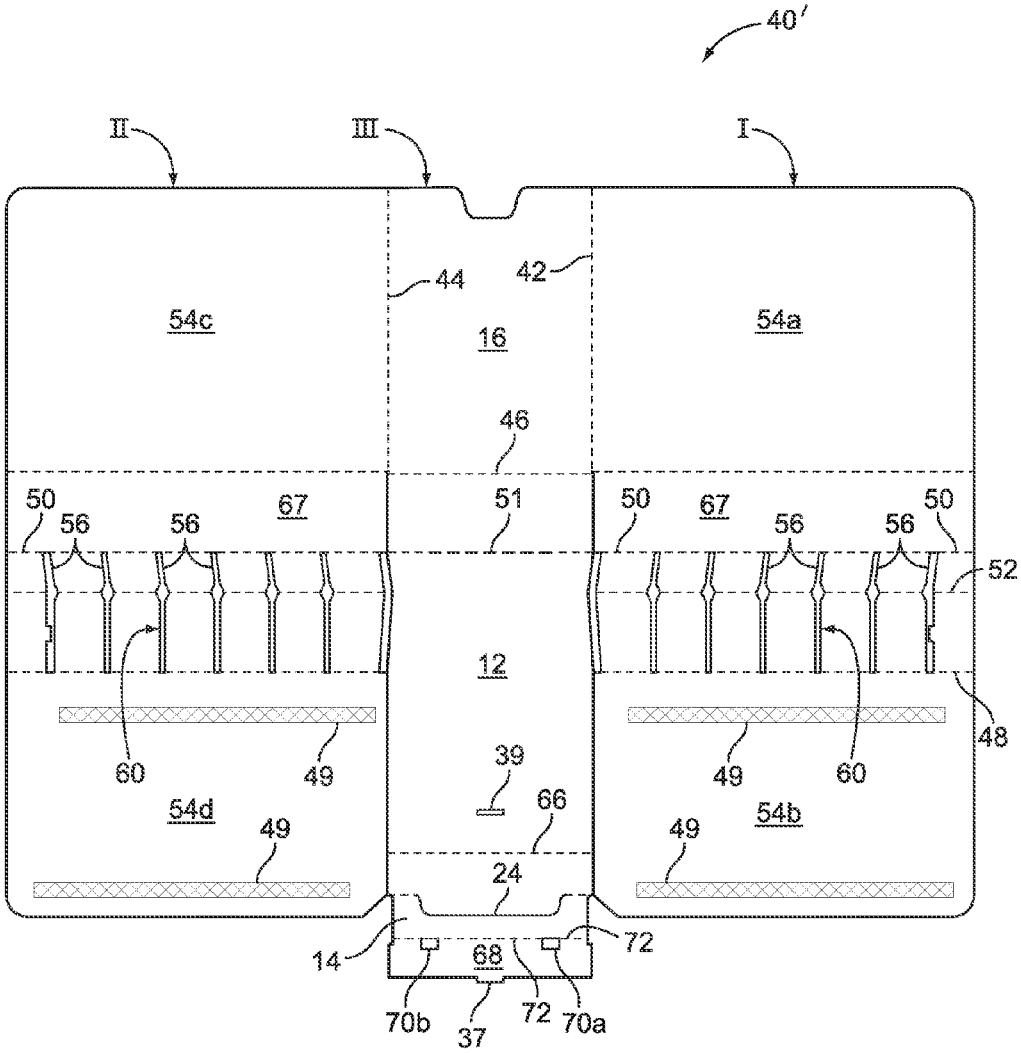
FIG. 4 is an alternative blank used to construct the display tray shown in FIGS. 1 and 2.

FIG. 4 is an alternative blank 40' used to construct the display tray 10 shown in FIGS. 1 and 2. The blank 40' is substantially similar to the blank 40 except that the blank 40' is cut along its outer margins to form a rectangular and the slots 56 are a slightly angled. In addition, there is tab 37 formed on the free edge of the flap 68 which engages with the slot 39 located on the bottom wall 12 so that the front wall 14 is securely held to the side walls, the back wall, and the bottom wall.

Figure 5:
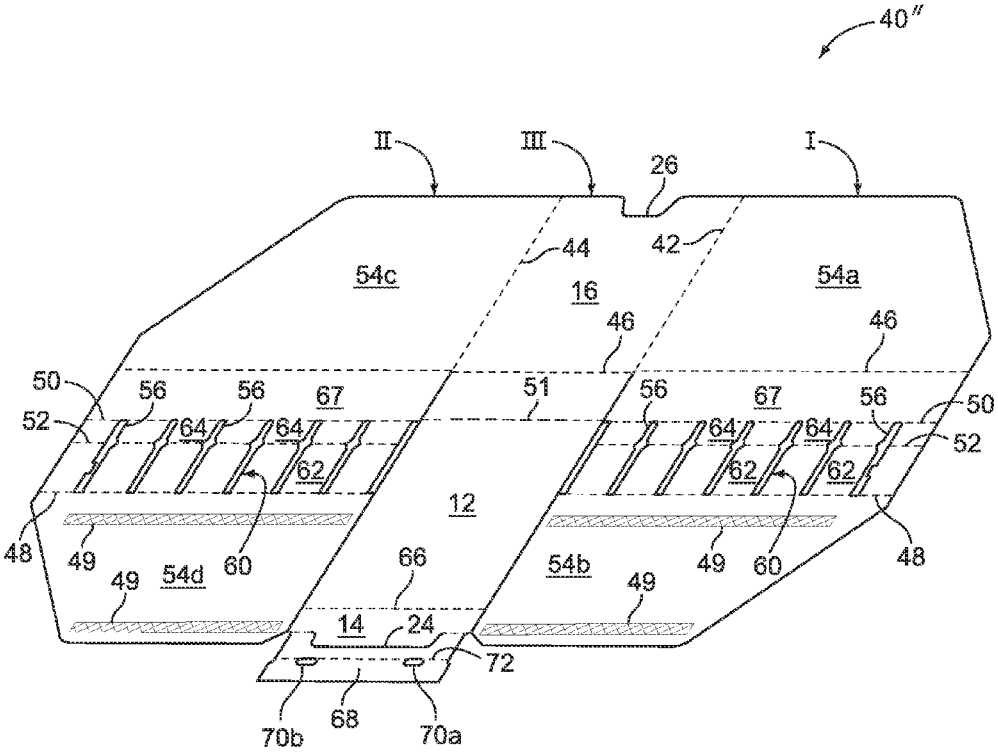
FIG. 5 is similar to FIG. 3 shown the top perspective view of the cut and scored paperboard blank for forming the display tray in FIGS. 1 & 2.

FIG. 5 is similar to FIG. 3 shown the top perspective view of the cut and scored paperboard blank 40" for forming the display tray 10 in FIGS. 1 & 2. The blank 40" is used to describe the folding sequences of the display tray 10.

Figure 6A:
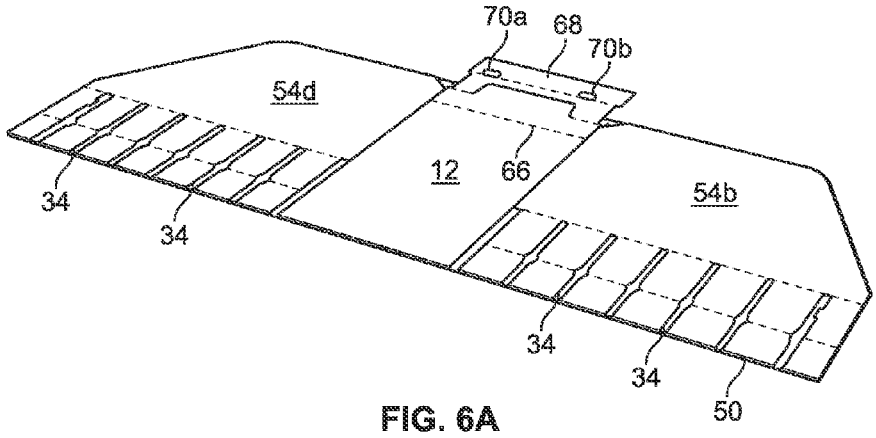
FIGS. 6A-6E illustrate the folding sequences of the blanks shown in FIGS. 3 & 4 for constructing the display tray in accordance to the preferred embodiment of the present invention.
Figure 6B:
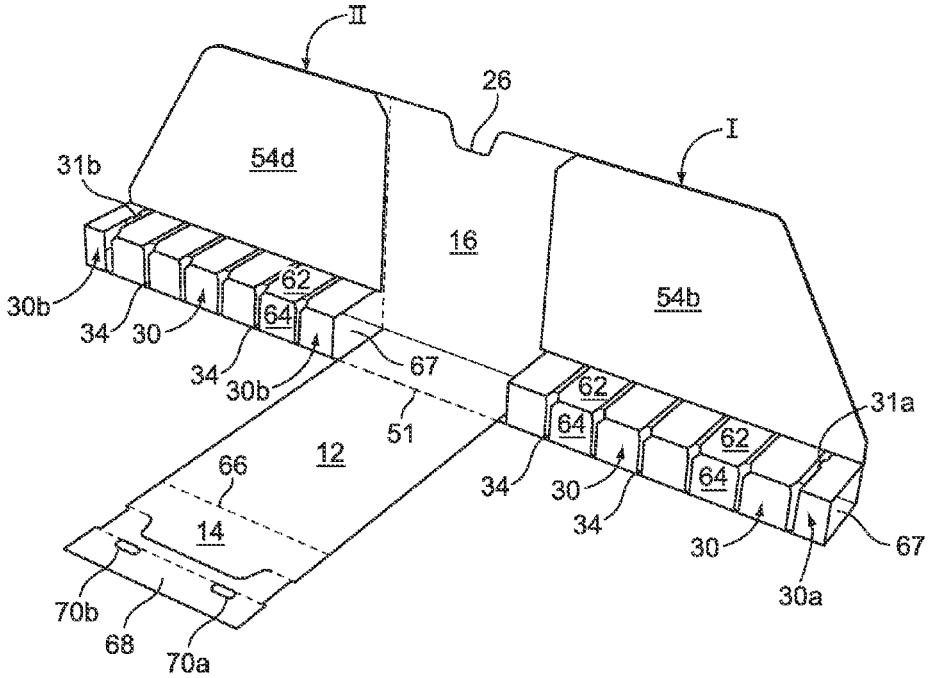
Figure 6C:
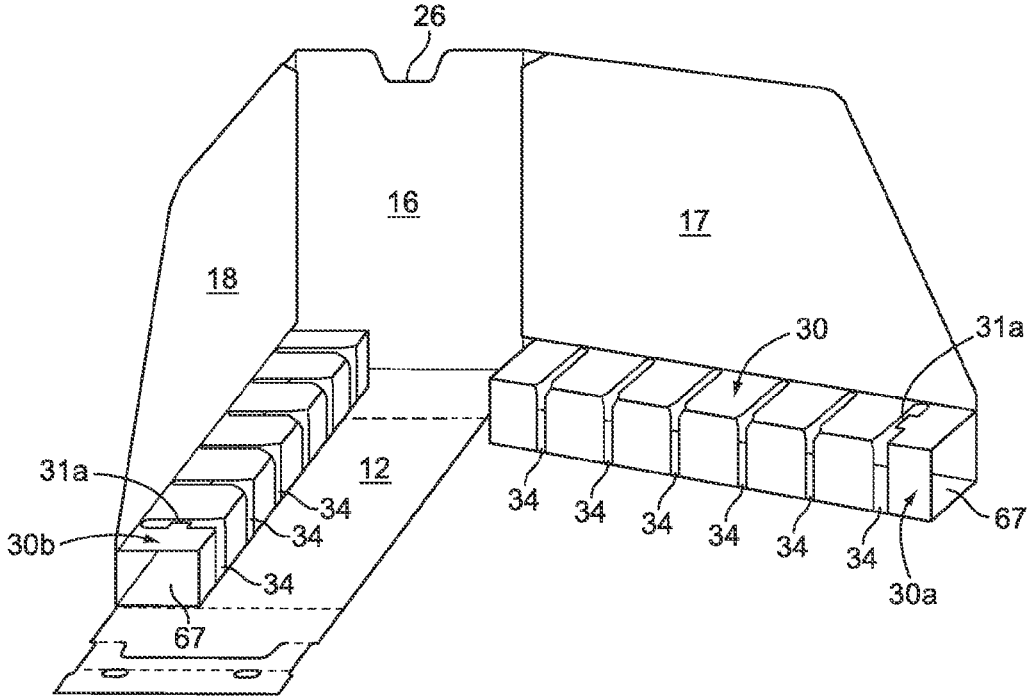
Figure 6D:
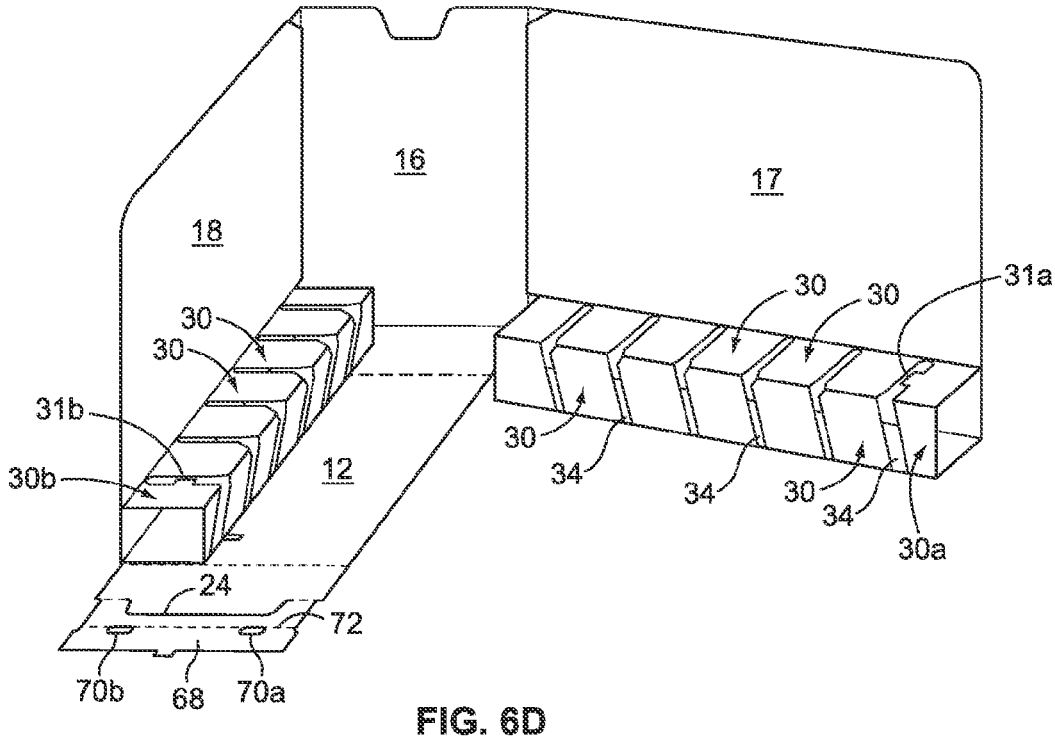
Figure 6E:
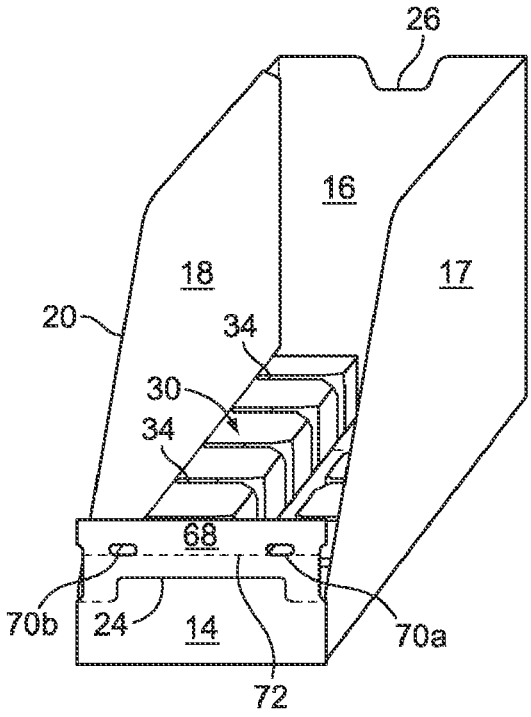
Figure 7:
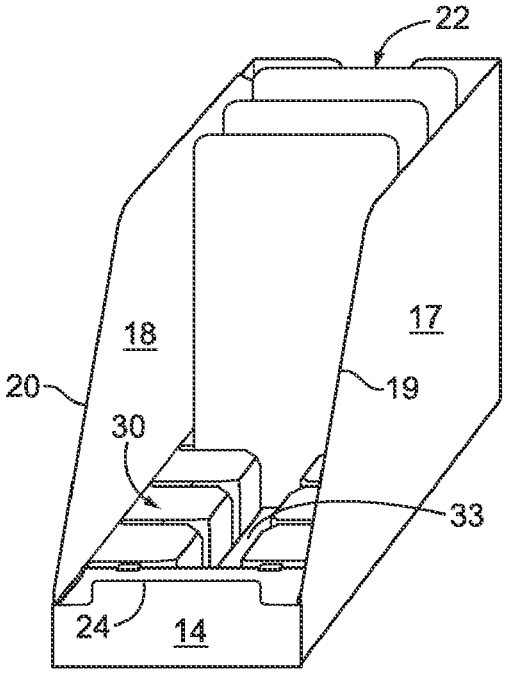
FIG. 7 is similar to FIG. 2 illustrating the display tray with partially loaded articles.

Referring to FIGS. 6A-6D, manual set-up of the display tray 10 is easily accomplished. However, an ordinary skilled in the art would appreciate that generally a folding machine may alternatively perform the forming operations. The blank 10 is laid horizontally and then folded 180 degrees along the fold line 50 as depicted in FIG. 6A. One side of the blank 40" is glued to the other side by the glue areas and thus the blank 40" is pre-glued in half. Next, the sections I, II are folded up 90 degrees with respect to the bumpers 30 and the bottom wall 12 and the front wall 14 are unfolded away from the back wall 16. It should be noted that when the sections I, II folded up at right angle, the bumpers 30 are formed as clearly depicted in FIG. 6B. Next, both of the sections I and II are rotated toward one another with respect to the bottom wall 12 and positioned on the bottom wall so that the bumpers 30 and the bottom wall form an aisle 33 as best shown in FIGS. 1, 6E, and 7. Finally, referring to FIGS. 6E and 7, the front wall 14 is folded upwardly at right angle along the fold line 66 and the flap 68 is folded at right angle with respect to the fold line 72 and then is inserted into the channel 34 formed by the bumpers 30 a, 30*b* and fully locked by inserting the tab 31*a*, 31*b* into respective openings 70*a*, 70*b*. It should be noted that although the FIG. 6D is constructed from the blank 40', but the folding sequences are exactly the same as FIG. 6A. In FIG. 6D the bumpers 30 are slightly tilted since it corresponds to the slots 56 formed in the blank 40'. The display tray 10 is now complete and ready to receive a plurality of blister cards as depicted in FIG. 8. To remove a blister card 22 from the display tray 10, a user simply pulls out the blister card with his thumb and index fingers.

The display tray 10 of the present invention is simple and economical in construction, requiring minimal parts and material, and effectively holds a plurality of articles in upright position when displayed for sale.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A shipping and display tray for holding a plurality of articles contained therein in an upright position at a point of sale, comprising:

a one-piece shallow tray having a bottom wall, a front wall, a back wall, and opposite side walls foldably joined with one another, a plurality of parallel spaced apart bumpers foldably joined to the respective opposite side walls and forming two rows, an aisle, and a plurality of channels when positioned on the bottom wall, the front wall includes a flap panel foldably joined thereto and wherein the flap panel has a pair of openings used to engage with the bumpers wherein two of the plurality of bumpers each of which includes a tab that is inserted into the respective openings the plurality of the channels engages with bottom edges of the plurality of articles to hold the article in standing upright position and prevent the articles from falling over when one of the articles is removed from the display tray.

2. The shipping and display tray of claim 1 wherein the front wall includes a pop-up front used to enhance surface area of the front wall for printing indicia.

3. The shipping and display tray of claim 1 wherein the each of the side wall adjacent the front wall is tapered to enhance exposure of the plurality of the articles.

4. The shipping and display tray of claim 1 wherein the back wall includes a U-shaped cutout formed therein to facilitate the removal of the last the plurality of the articles.

5. The shipping and display tray of claim 1 is made of paperboard.

6. A shipping and display tray for holding a plurality of articles contained therein in an upright position at a point of sale, comprising:

a one-piece shallow tray having a bottom wall, a front wall having a flap panel foldably joined thereto, a back wall, and opposite side walls foldably joined with the flap panel, the bottom wall contains a plurality of parallel spaced apart bumpers having at least one row, the flap panel has a pair of openings used to engage with the bumpers wherein two of the plurality of bumpers each of which includes a tab that is inserted into the respective openings and a plurality of channels used to engage with bottom edges of the plurality of articles to hold the article in standing upright position and prevent the articles from falling over when one of the articles is removed from the display tray.

7. A blank for making a shipping and display tray for supporting a plurality of articles in an upright position and displaying them at the point of sale, comprising:

a rectangularly shaped bottom wall panel having opposite end edges and opposite side edges, the bottom wall includes a slot formed therein;

a side wall panel foldably attached to each of the opposite side edges;

a front wall panel foldably attached to one of the opposite end edges of the bottom wall panel, the front wall panel being defined by a flap panel and a pop-up front foldably joined to one another, a pair of openings being formed on the flap panel wherein the flap panel includes a tab at free edge thereto that being engaged with slot on the bottom wall when the blank is in folded position; and a plurality of spaced apart parallel slots extending across two parallel fold lines formed on the side wall panels.

8. The blank of claim 7 is folded transversely in half along a fold line to join the side wall panels to one another along glue areas.

* * * * *